United States Patent [19]

Hubbard

[11] Patent Number: 4,556,271

[45] Date of Patent: Dec. 3, 1985

[54] HERMETICALLY SEALED CONNECTOR

[75] Inventor: George M. Hubbard, Hamden, Conn.

[73] Assignee: M/A-COM Omni Spectra, Inc., Merrimack, N.H.

[21] Appl. No.: 542,106

[22] Filed: Oct. 14, 1983

[51] Int. Cl.[4] ..... H01R 4/00

[52] U.S. Cl. ..... 339/94 C; 339/177 R

[58] Field of Search ..... 339/89 R, 89 C, 177, 339/94, 60

[56] References Cited

U.S. PATENT DOCUMENTS

| | | | |
|---|---|---|---|
| 3,022,482 | 2/1962 | Waterfield et al. | 339/94 C |
| 3,371,413 | 3/1968 | Rundle | 339/177 E |
| 3,437,982 | 4/1969 | O'Keefe et al. | 339/177 R |
| 3,441,898 | 4/1969 | Nodfelt | 339/60 M |
| 3,673,546 | 6/1972 | Green et al. | 339/89 C |
| 3,904,264 | 9/1975 | Oertle | 339/94 C |
| 3,994,553 | 11/1976 | Kornick | 339/60 R |
| 4,368,940 | 1/1983 | Suquira | 339/177 E |

*Primary Examiner*—Gil Weidenfeld
*Assistant Examiner*—David L. Pirlot
*Attorney, Agent, or Firm*—Hayes, Davis & Soloway

[57] ABSTRACT

A hermetically sealed connector, suitable for use in the construction of a launcher for the transfer of energy from a coaxial cable to an integrated circuit, comprising an annular body defining a bore in which is disposed an annular insulator which in turn supports a central electrical contact, said body defining an external thread of relatively large diameter adapted for the connection of a coaxial connector thereto with the central contact of the connector in communication with the central contact, and having an annular extension defining a thread of relatively small diameter;

an annular header defining a thread by which the header is connected to the body extension and a thread of relatively large diameter by which the header may be attached to a structure; and a hermetic seal means housed within said header in sealing engagement with said body in said header, said seal means including an elongate conductor extending from said central contact through said seal means in sealing engagement therewith.

12 Claims, 3 Drawing Figures

HERMETICALLY SEALED CONNECTOR

The present invention relates to hermetically sealed connectors and particularly, though not exclusively, to through panel or housing connectors or launchers suitable for connecting integrated circuits to a coaxial cable.

An example of a watertight coaxial connector may be found in U.S. Pat. No. 4,299,434 and of a hermetically sealed connector in U.S. Pat. No. 4,296,986. Further examples of hermetically sealed connectors may be found on pages 41, 42, 43, and 44 of the Catalog entitled "Microwave Coaxial Connectors" of Omni Spectra, Inc. No. 2179-30M-S6-SUL.

Prior art hermetically sealed connectors particularly those used as through panel connectors or launchers which form a hermetic seal as a result of threading into a panel or housing have utilized hermetic seal arrangements in which the integrity of the hermetic seal is easily destroyed during the removal of connector body parts. Prior art panel connectors or launchers of this type are typically constructed in a one piece body form of a size, for example, as shown on page 42 of the aforementioned catalog under part number 2058-5119-00, which is screwed into a panel or housing with a central contact extending through the panel or into the housing. If these connectors or launchers are damaged, the one piece body must be removed after solder connections are broken. This has the undesirable and inherent effect of breaking the hermetic seal.

It is the object of the present invention to provide an improved hermetically sealed connector, particularly for use as a through panel connector or launcher, preferably of two-part body construction, from which a connector body can be removed, without disturbing the integrity of the hermetic seal, using simple tools, with a simple and economical construction and which is economical to produce and compact in form.

According to the invention, there is provided a hermetically sealed connector, suitable for use in the construction of a launcher for the transfer of energy from a coaxial cable to an integrated circuit, comprising an annular body defining a bore in which is disposed an annular insulator which in turn supports a central electrical contact, said body defining an external thread of relatively large diameter adapted for the connection of a coaxial connector thereto with the central contact of the connector in communication with the central contact, and having an annular extension defining a thread of relatively small diameter;

an annular header defining a thread by which the header is connected to the body extension and a thread of relatively large diameter by which the header may be attached to a structure; and a hermetic seal means housed within said header in sealing engagement with said body in said header, said seal means including an elongate conductor extending from said central contact through said seal means in sealing engagement therewith.

The invention will now be described, by way of example, with reference to the accompanying drawings in which.

Figure 1:
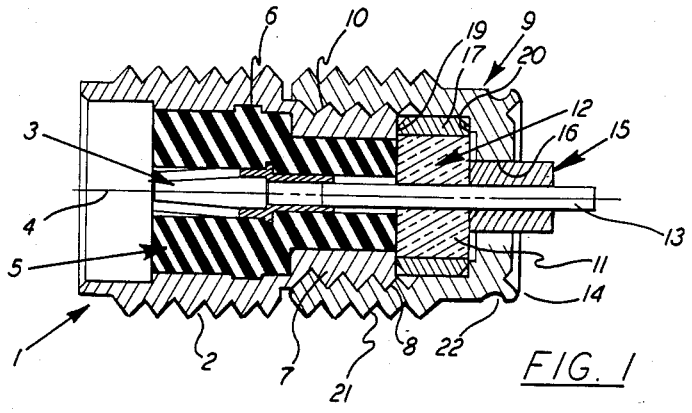
FIG. 1 is a sectional elevation of a hermetically sealed launcher for connection to a cable plug, for example, a semi-rigid coaxial cable plug, for the transfer of energy therefrom to an integrated circuit.

With reference to FIG. 1, an annular monolithic body which is externally threaded with a thread 2 of 0.250 inches diameter and having a pitch which provides 36 threads per inch. The body 1 supports a female contact 3 upon its longitudinal axis 4 by means of an annular insulator 5 supported within the body and located longitudinally thereof by an annular flange and recess 6. The body, insulator and contact being adapted for connection to a coaxial plug, for example, a semi-rigid cable coaxial plug.

The body 1 carries a rear extension 7 on the exterior of which is formed a thread 8 of 0.190 inches diameter and having a pitch which provides 36 threads per inch. Threads 2 and 8 are of identical form and cross-section. A monolithic annular header 9 is connected to the body 1 by means of an internal thread 10 which cooperate with threads 8. The header 9 define a cylindrical cavity 11 in which is housed a hermetic seal sub-assembly 12 having a central elongate conductor 13 extending from electrical communication with the female contact 3 through the rear 14 of the header 9 from which rear 14 the conductor 13 is electrically insulated by an annular rear insulator 15 closely received in a cylindrical opening 16 in the rear 14 of the header 9.

Figure 2:
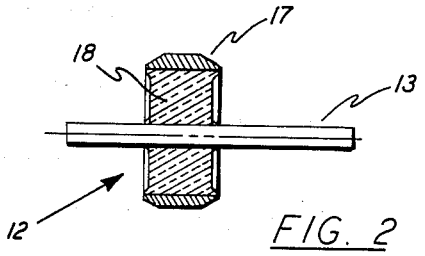
FIG. 2 is an enlarged fragmentary sectional elevation of a hermetic seal sub-assembly of the launcher illustrated in FIG. 1.

With reference now to FIG. 2, the hermetic seal sub-assembly 12 comprises the conductor 13, of elongate cylindrical form, spaced around a longitudinally extending portion of which is a bushing 17 supported symmetrically about the conductor by a glass (or other ceramic or a combination of glass and another ceramic) seal 18 which is sealed to the bushing and the conductor by a glass to metal seal to form a unitary structure.

Figure 3:
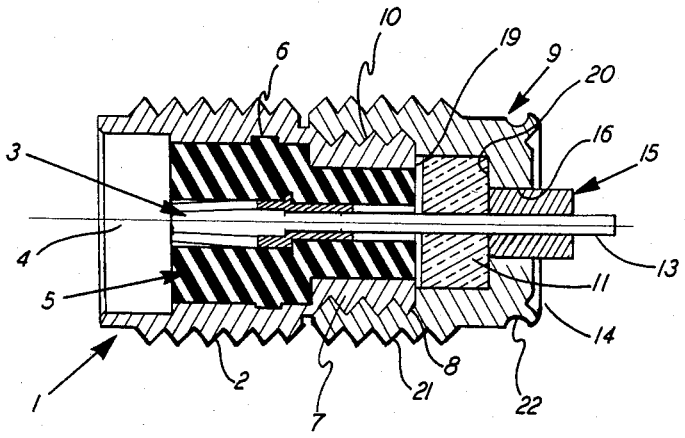
FIG. 3 is a sectional elevation of an alternative construction to that illustrated in FIG. 1.

With reference once again to FIG. 1, the bushing 17 of the hermetic seal sub-assembly 12 is positioned in the cylindrical cavity 11 and lies between an annular rear face 19 of the rear extension 7 and an internal annualar face 20 of the header 9 which serves to define a part of the cylindrical cavity 11, and is soldered or brazed in place. This hermetically seals the header. Alternatively, as shown in FIG. 3, header 9 may be fused directly to the glass seal 18 in known manner.

The exterior of the header 9 carries a mounting thread 21 of 0.250 inches diameter and having a pitch which provides 36 threads per inch with the thread form being similar to that of thread 2. The exterior of the header also carries an annular groove 22 adjacent its rear 14. Thread 21 facilitates the mounting of the launcher through a panel or to a structure in hermetically sealed relationship therewith.

By virtue of the relatively small diameter of threads 8/10 compared to the relatively large diameter of threads 2/21, the helix angle (i.e. the angle of the helical extension of the threads to a circumferential line defining a plane normal to the axis 4) of threads 8/10 is larger than that of threads 2/21. This difference in helix angle coupled with the use of threads of the same form in cross-section for the threads 8/10 and 2/21 ensures that threads 8/10 will break loose first, upon application of a removal torque to the body/header, leaving the threaded connection between the header and panel or housing to which the connector is attached undisturbed. This ensures that the integrity of the hermetic sealing of the connector remains undisturbed when a damaged body is removed for repair or replacement as the header remains attached to the panel or housing throughout this operation.

Typically the header to panel or housing threaded connection and the threads 8/10 are tightened with a torque of 25 inch-pounds while a coaxial connector to thread 2 connection is tightened with a torque of 7 to 10 inch-pounds.

It will be appreciated that while the present invention has been described as having a female contact for connection to a connector plug, the present invention could equally well have a male contact for connection to a female connector.

As will be well known in the art of producing glass to metal seals in seals of the type illustrated in FIG. 2, the glass utilized for the hermetic seal and the material of the central contact and bushing must be chosen to be compatible for the production of glass to metal seals (including having rates of thermal expansion substantially matched to one another). In the arrangement of FIG. 3, the header has a substantially higher thermal expansion rate than the glass seal and is arranged to hold the glass seal in compression following formation of the glass to metal seals.

By the utilization of a two part launcher as described, a launcher of substantially the same size as prior art launchers is provided with the consequence that there is no sacrifice in space or installation technique in utilizing the present invention while at the same time maintenance and replacement of attached connectors will not destroy the integrity of the hermetic sealing arrangements.

While the present invention has not been described with reference to the use of any particular materials, suitable materials will be apparent to a man skilled in the art, including constructing the electrically conductive components from any suitable material including stainless steel and that these components may be gold plated.

I claim:

1. A hermetically sealed connector, suitable for use in the construction of a launcher for the transfer of energy from a coaxial cable to an integrated circuit, comprising an annular body defining a bore in which is disposed an annular insulator which in turn supports a central electrical contact, said body defining an external thread of relatively large diameter adapted for the connection of a coaxial connector thereto with a central contact of the connector in communication with the central contact, and having an annular extension defining a thread of relatively small diameter; and an annular header defining a thread by which the header is connected to the body extension and a thread of relatively large diameter by which the header may be attached to a structure;

wherein said relatively large diameter thread of said header and said relatively small diameter thread have pitches whereby the relatively small diameter threads will untighten upon the application of an undoing torque to the body while the relatively large diameter thread when interconnecting the header to said structure remains tight without an external restraining torque applied to the header to prevent its untightening.

2. A connector according to claim 1 wherein said relatively large thread of said header is for mounting said header through a panel or to a structure with said central conductor extending through said panel or structure.

3. A connector according to claim 1 wherein said central conductor extends through said header axially thereof and is spaced therefrom by an annular insulator.

4. A connector according to claim 1 comprising a hermetic seal means housed within said header in sealing engagement with said body in said header, said seal means including an elongate conductor extending from said central contact through said seal means in sealing engagement therewith.

5. A connector according to claim 1 wherein the body and header are monolithic structures.

6. A connector according to claim 5 wherein said header defines a cylindrical chamber in which said hermetic seal means is sealingly held, to provide the hermetic seal of the header.

7. A connector according to claim 6 wherein said hermetic seal means comprises said elongate conductor supported centrally within an annular bushing and spaced therefrom by a ceramic which is hermetically sealed to the central conductor and the bushing.

8. A connector according to claim 1 wherein said relatively large diameter thread of said header and said relatively small diameter thread have the same pitch thereby to provide said relatively small diameter thread with a helix angle larger than that of the relatively large diameter thread.

9. A connector according to claim 8 wherein the relatively large diameter thread and the relatively small diameter thread have the same cross-sectional form.

10. A connector according to claim 9 wherein the relatively large diameter thread and the relatively small diameter thread have the same cross-sectional size.

11. A hermetically sealed connector, suitable for use in the construction of a launcher for the transfer of energy from a coaxial cable to an integrated circuit, comprising an annular body defining a bore in which is disposed an annular insulator which in turn supports a central electrical contact, said body defining an external thread of relatively large diameter adapted for the connection of a coaxial connector thereto with a central contact of the connector in communication with the central contact, and having an annular extension defining a thread of relatively small diameter;

an annular header defining a thread by which the header is connected to the body extension and a thread of relatively large diameter by which the header may be attached to a structure; wherein said relatively large diameter thread of said header and said relatively small diameter thread have the same pitch thereby to provide said relatively small diameter thread with a helix angle larger than that of the relatively large diameter thread whereby the relatively small diameter threads will untighten upon the application of an undoing torque to the body while the relatively large diameter thread when interconnecting the header to a said structure remains tight without an external restraining torque applied to the header to prevent its untightening.

12. A connector according to claim 11 comprising a hermetic seal means housed within said header in sealing engagement with said body in said header, said seal means including an elongate conductor extending from said central contact through said seal means in sealing engagement therewith.

* * * * *